United States Patent [19]

Fuhring et al.

[11] 3,986,273

[45] Oct. 19, 1976

[54] DRYING APPARATUS FOR A CONTINUOUSLY MOVING WEB

[75] Inventors: Heinrich Führing; Winfried Steitz, both of Augsburg, Germany

[73] Assignee: Firma Bowe Bohler & Weber KG, Augsburg, Germany

[22] Filed: June 5, 1974

[21] Appl. No.: 476,597

[30] Foreign Application Priority Data

June 7, 1973 Germany ..... 2328957

[52] U.S. Cl. ..... 34/155; 34/156; 432/59

[51] Int. Cl.[2] ..... F26B 13/06; F26B 13/08

[58] Field of Search ..... 34/10, 155, 156, 160, 34/161; 432/8, 59

[56] References Cited

UNITED STATES PATENTS

| | | | |
|---|---|---|---|
| 2,199,233 | 4/1940 | Williams | 34/161 X |
| 3,060,594 | 10/1962 | Meier-Windhorst | 34/160 X |
| 3,116,124 | 12/1963 | Eolkin | 34/156 |
| 3,181,250 | 5/1965 | Vits | 34/156 X |
| 3,262,688 | 7/1966 | Beggs | 432/8 X |
| 3,577,651 | 5/1971 | Nichols | 34/155 |

*Primary Examiner*—John J. Camby
*Attorney, Agent, or Firm*—Karl F. Ross; Herbert Dubno

[57] ABSTRACT

An apparatus for drying a continuously moving web has a housing defining a vertical zigzag path having a succession of oppositely directed and inclined stretches each flanked by a pair of parallel and confronting walls each in turn provided with an array of nozzles. Rollers are provided at the ends of the stretches for reversal and guiding of the web, and a blower is provided whose pressure side is connected to the nozzles for creating a gas cushion to each side of the web which supports the web and guides it along the path. Each of the walls is corrugated in a direction perpendicular to the direction of travel of the web, and the nozzles are provided on each side of the crests of the corrugations. The gas cushion is drawn off at the ends of the troughs of the corrugations.

6 Claims, 10 Drawing Figures

Fig.1
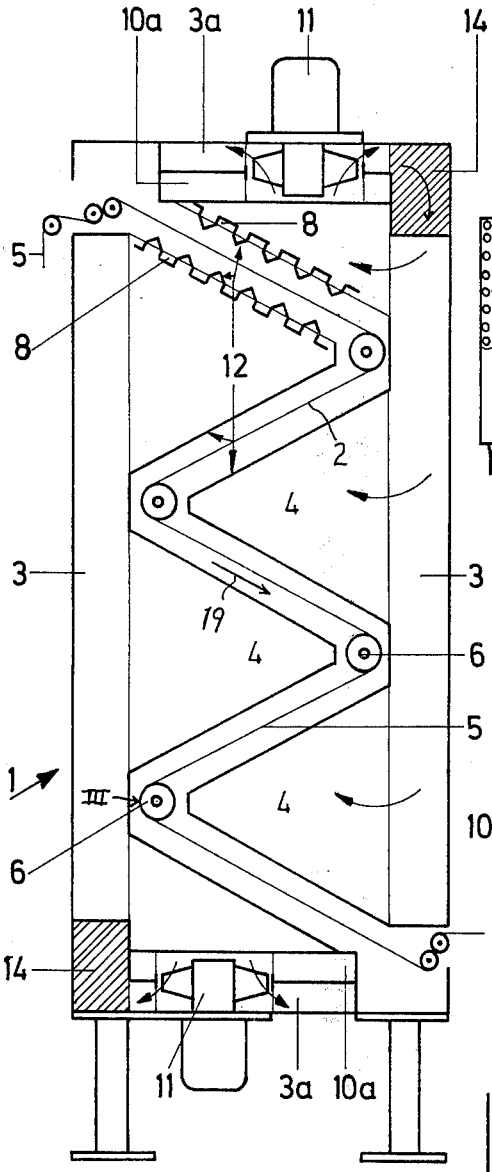
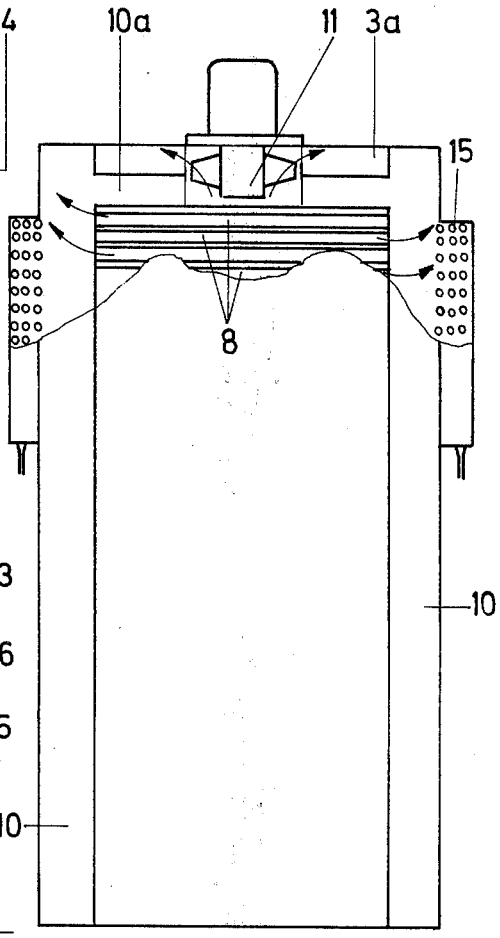
Fig. 2
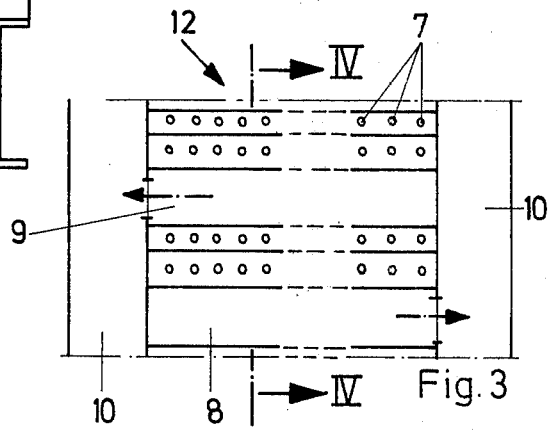
Fig. 3
Fig. 4
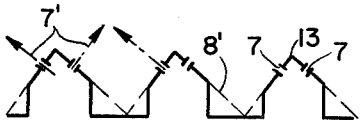
Fig. 5
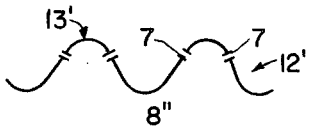

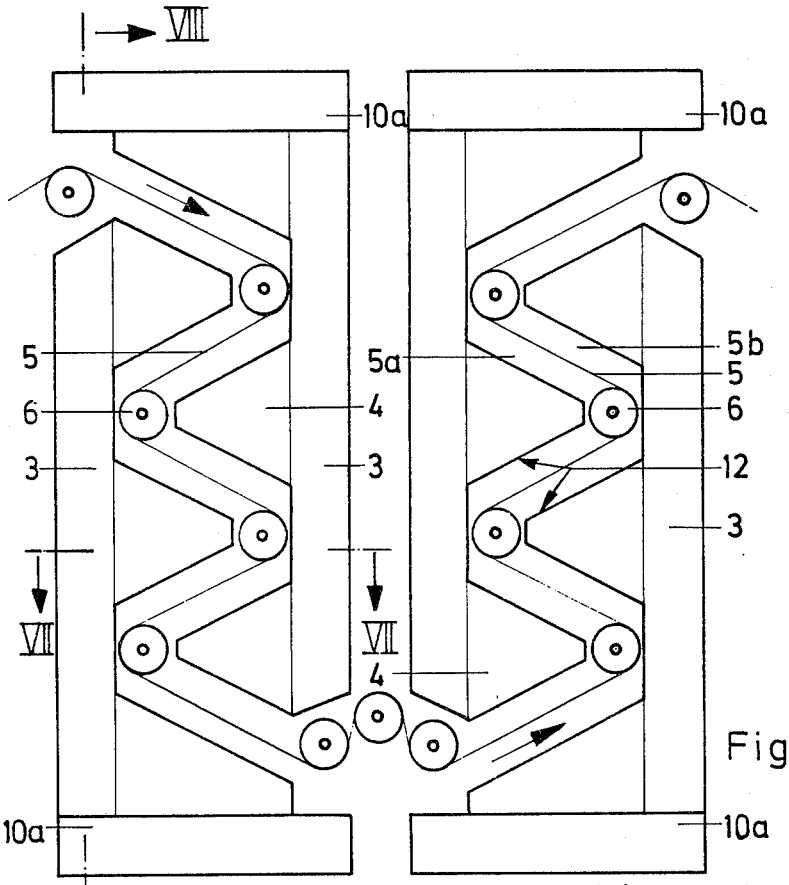
Fig. 6
Fig. 9
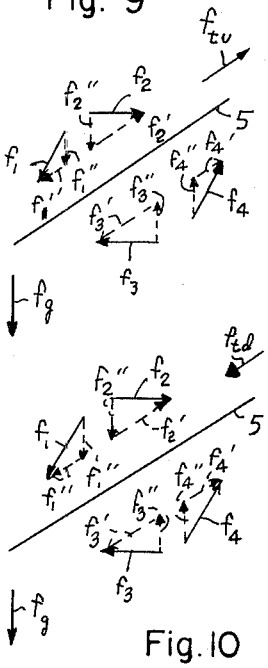
Fig. 10
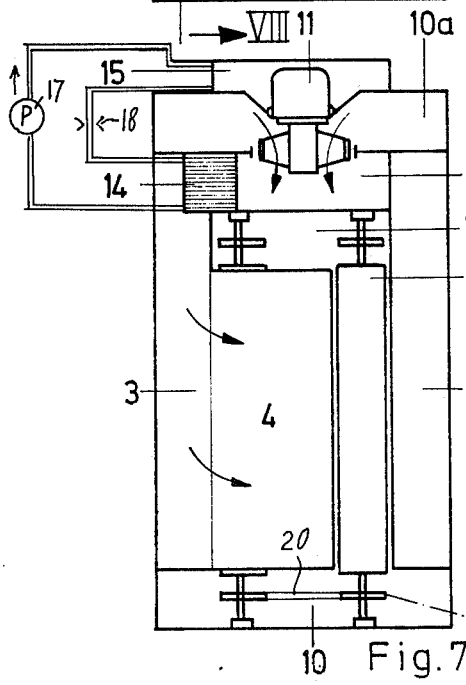
Fig. 7
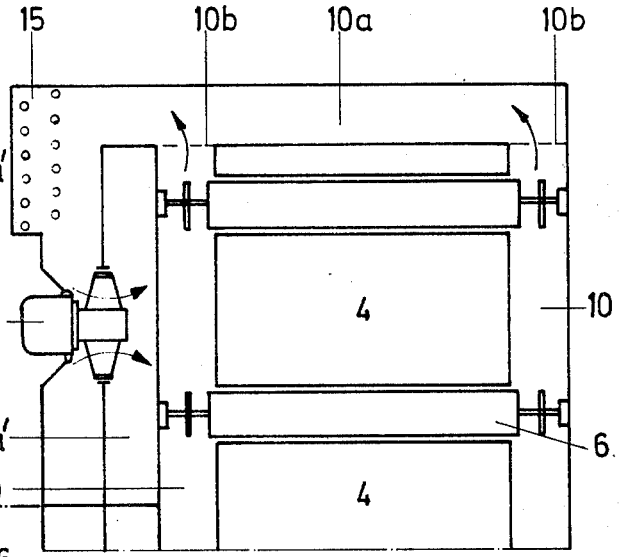
Fig. 8

DRYING APPARATUS FOR A CONTINUOUSLY MOVING WEB

FIELD OF THE INVENTION

The present invention relates to an apparatus for treating a web. More particularly this invention concerns an apparatus for fixing or drying a textile web which is passing continuously through the apparatus.

BACKGROUND OF THE INVENTION

In the production of textiles it is frequently necessary to treat them with a gas so as to dye them, remove solvent from them, or simply dry the the textiles. In most manufacturing processes the textile is produced as an elongate web which is passed longitudinally through the various treatment stages, including the apparatus used to treat the textile with a gas.

In a known apparatus the textile passes straight in a horizontal line between a pair of spaced-apart parallel horizontal surfaces each provided with a plurality of nozzles to which air is supplied so as to form a gas cushion above and below the textile. This gas cushion supports the textile web as it moves longitudinally horizontally through the device and at the same time dries or fixes the textile, depending upon the function which the apparatus is to serve. The advantage of such a device is that the longitudinal and transverse tensions in the web are reduced to a minimum so that stretching or deformation of this web is almost completely eliminated. On the other hand such an apparatus has the considerable disadvantage that it occupies a great deal of floor space. In addition the web has a tendency to oscillate in a direction transverse to its transport direction, these oscillations potentially damaging the web which is frequently very weak in its wet state. In addition when the apparatus treats a relatively long piece of such a web the force necessary to pull it through, even though it is only floating on a cushion of air, is still considerable, especially when the web is wet.

It has been suggested to avoid many of these disadvantages by guiding the web positively by means of guiderails extending through the apparatus. This has been found extremely disadvantageous in that the access of the gas to the web is reduced in certain areas and the web is frequently damaged by the guide rails.

In another arrangement the web is gripped at its longitudinal edges by means of clips carried on a conveyor chain so that the web can be readily guided along a path, which in this case need not be horizontal but can be vertical, or, more efficiently, comprise a series of stretches which extend parallel to each other and allow the web to be passed through a path of maximum length which occupies a minimum amount of floor space. Such devices have the disadvantages that they are very expensive and frequently damage the web at its edges.

OBJECTS OF THE INVENTION

It is therefore an object of the present invention to provide an improved method of and apparatus for treating a continuously moving web with a gas.

Another object is the provision of such an apparatus which occupies a minimum amount of floo space, is relatively inexpensive to manufacture, and will damage the web minimally.

A further object is to provide an apparatus of the above-described general type which can be used for the drying or fixing of a textile web.

SUMMARY OF THE INVENTION

These objects are attained according to the present invention in an apparatus for treating a textile web comprising a housing defining a vertical zigzag path having a succession of oppositely directed and inclined stretches each flanked by a pair of parallel and confronting walls each in turn provided with an array of nozzles. Means is provided in the housing for guiding an elongated web along the path through the housing and means is provided for supplying a gas to the nozzles for creating a gas cushion to each side of the web in each stretch, acting as the sole support of the web in the housing.

Thus in accordance with the present invention it is possible to dispense with complicated clamping and holding arrangements, the guide means merely serving to insure that the web does not come in contact with any of the walls should the gas supply fail.

In accordance with another feature of this invention the nozzles are not directed perpendicular to the web nor parallel thereto, but are arranged in two groups, one pointing in a forward direction relative to the direction of travel of the web, and another group pointing generally backwardly. These groups of nozzles exert forces upon the web which have the net effect of canceling out its weight, so that the web floats at a predetermined position between the two walls. These forces serve to brake the web on the downhill run and to advance the web on an uphill run, so that longitudinal stresses in the web are reduced to an absolute minimum.

According to yet another feature of this invention means is provided for withdrawing the gas from between the walls in a direction parallel to the web but transverse to the transport direction thereof. This is accomplished in accordance with the present invention by forming each of the walls with a plurality of waves or corrugations, the nozzles being formed at the crest of the corrugations and the air being aspirated at the valleys thereof. These corrugations extend parallel to each other and to the web but perpendicular to the transport direction of the web. The suction arrangement is connected so as to draw the gas in one direction from every other valley of each wall and in the opposite direction from the remaining valleys.

According to still another feature of this invention the means for supplying the gas, here air, and the suction arrangement are interconnected and form a generally closed circuit so that the same air is constantly expelled from the nozzles on the crests of the corrugations of the walls and drawn in at the valleys thereof. In accordance with another feature of this invention a heater is provided immediately upstream of the nozzles, and a cooler or condenser is provided immediately downstream of the intake openings so as to strip vapor from the circulating air.

BRIEF DESCRIPTION OF THE DRAWING

The above and other objects, features and advantages will become more readily apparent from the following description, reference being made to the accompanying drawing in which:

FIGS. 1 and 2 are side elevational views partly in section and taken at right angles to each other illustrating the apparatus according to the present invention;

FIG. 3 is a view taken in the direction of arrow III of FIG. 1;

FIG. 4 is a section taken along line IV — IV of FIG. 3;

FIG. 5 is a view similar to that of FIG. 4 illustrating an alternative form of wall in accordance with the present invention;

FIG. 6 is a side view of another apparatus in accordance with the present invention;

FIGS. 7 and 8 are sections taken along line VII — VII and VIII — VIII, respectively, of FIG. 6; and FIGS. 9 and 10 are vector diagrams illustrating principles of the present invention.

SPECIFIC DESCRIPTION

As shown in FIGS. 1 – 4 the apparatus according to the present invention has a housing 1 defining a zigzag path 2 having a plurality of straight stretches which extend at angles of 55° to each other. A web 5 continuously moving in direction 19 is guided along this path 2 by rollers 6 which are coated with ploytetrafluorethylene for minimum frictional resistance and which are situated at the intersections of adjoining stretches of the path 2.

Flanking each of the stretches of the path 2 is a pair of parallel walls 12 which are corrugated, having troughs 8 and crests 13 extending parallel to each other and perpendicular to the direction 19 of travel of the web 5. The walls 12 are formed to each side of each crest 13 with a row of small openings 7 constituting nozzles. These walls 12 also form the walls of a pressure chamber 3 connected via another high-pressure chamber 3*a* to the pressure side of a blower 11. Thus gas is expelled from the nozzles 7 as indicated by arrows 7′ in FIG. 4. These nozzles 7 therefore form a uniform gas cushion to each side of the web 5.

Each of the troughs 8 opens at one end through a hole 9 into a suction chamber 10 connected via a low-pressure chamber 10*a* to the suction side of the blower 11. Each trough 8 is provided with an opening which is to the end of that trough opposite the end at which the opening of the adjoining trough is provided, as shown in FIG. 3. Thus the blower 11 will expel air or another suitable gas from the nozzles 7 to form a cushion to each side of the web 5, and this gas will be drawn off from the trough 8 via the openings 9.

As is shown in FIG. 4 each of the crests 13 is triangular in cross section, being formed of two elongated planar surfaces meeting at a pointed ridge. Each of the troughs 8 is rectangular in cross section, being formed of three planar surfaces lying at right angles to one another. It is also possible as shown at 8′ in FIG. 4 to form the trough as a triangular-section continuation of the surfaces constituting the crests 13. FIG. 5 also shows how a sinusoidally corrugated wall 12′ can be provided instead of the wall 12 shown in FIG. 4, this wall 12′ having rounded crests 13′ and rounded troughs 8″.

The pressure chambers 3 are each provided with a hot heat-exchanger coil 14 so that the air expelled from the nozzle 7 will be at a predetermined elevated temperature. Similarly the low-pressure chambers 10 are each provided with a pair of cooler or condenser coils 15 so as to cool the air drawn out through the openings 9, condensing therefrom any vapor so as to recover chlorhydrocarbon solvents such as perchlorethylene or trichlorethylene. Since neither the heated nor cooled exchangers 14 are directly in the path of the air flow, but are merely provided in the chamber in which the air circulates, they do not impair the overall efficiency of the system.

The housing 1 according to the present invention therefore has a pair of like parts each of which is formed with a plurality of tooth-like extensions 4 carrying two walls 12 and fitting between a similar pair of extensions 4 on the other part. In addition each part has its own blower 11, its own pressure chambers 3*a* and 3, and its own suction chambers 10*a* and 10.

The arrangement shown in FIGS. 6 – 8 is identical to that shown in FIGS. 1 – 4 except that the blowers 11 and the chambers 10*a* and 3*a* are here provided on the sides of the arrangement. One such blower 11 is provided at each of the extensions 4 for maximum effect. FIG. 7 shows how a pump 17 has a pressure side connected to the heater 15 which is in turn connected through an expansion valve to the cooler 14 in turn connected to the suction side of the pump 17 to constitute a closed-circuit heating/cooling arrangement. The web 5 as it passes through the apparatus draws off a portion of the heat generated by the system 14, 15, 17 and 18. The apparatus shown in FIG. 6 comprises two housings 1 with the web descending in the one ascending in the other.

The vector diagrams of FIGS. 9 and 10 illustrate the operation of the system. As illustrated by arrows 7′ of FIG. 4 the nozzles 7 emit jets of air which are not parallel to the transport direction $f_{tu}$ nor parallel to the direction $f_g$ of gravity. Thus the nozzles above the web 5 produce jets whose components of force are illustrated at $f_1$ and $f_2$ and which produce a cushion of air 5*b*, whereas the nozzles 7 below the web 5 produce jets that are illustrated at $f_3$ and $f_4$. Each of these quantities can be resolved into vectors $f_{1'}$ $-f_{g4'}$ parallel to the direction of transport $f_{tu}$, and into vectors $f_{1''}$ $-f_{4''}$ parallel to the direction of gravity $f_g$.

In accordance with the present invention when, as shown in FIG. 9 the web 5 is moving up, in direction $f_{tu}$, the net force of vectors $f_{1'}$ $-f_{4'}$ parallel to this direction is in this direction so as to advance the web 5. In addition the net force of the vectors $f_{1''}$ $-f_{4''}$ is opposite and equal to the force of gravity $f_g$ so as to perfectly counterbalance this force and to cause the web 5 to float along the path 2. The force exerted by the stream coming from each of the nozzles 7 is controlled by the diameter of this nozzle 7, so that the nozzles underneath the web will be of slightly greater diameter than those above the web, whereas those facing upstream will be larger than those facing downstream.

FIG. 10 shows how a web 5 moving down in the direction $f_{td}$ is similarly supported by the cushion 5*a* beneath it, while the net force opposite the upstream direction serves to brake the web, preventing it from passing too rapidly through the device and eliminating longitudinal stresses therein. Thus even a very wet, and correspondingly heavy, web 5 is made to float between the walls 12 by directing jets of air against this web having an overall component vertically upwardly against the force of gravity that cancels out the weight and another component parallel to the direction of travel of the workpiece and generally upwardly directed so as either to aid in the advance of the workpiece when it is traveling upwardly or to slow the workpiece down when it is traveling downwardly. Both FIGS. 9 and 10 show that the distance of vertical movement over each ramp is less than the ramp length.

FIG. 7 also shows how the rollers 6 may be interconnected by a belt 20 and driven by a motor 21.

We claim:

1. An apparatus for treating an elongated web moving in a transport direction, said apparatus comprising:

a housing means defining a vertical zig-zag path having a succession of oppositely directed and inclined stretches having angular intersections, the stretches alternately extending to right and left and having a vertical rise distance less than the horizontal travel;

a pair of generally parallel and confronting walls in said housing and flanking each of said stretches above and below the web;

means in said housing means guiding and passing said web along said path through said housing means in said direction, said guiding means including respective deflection elements at the intersections of adjacent stretches directing said web alternately from right to left and from left to right at the intersections, said deflection elements being disposed in two vertical rows and being staggered from side to side of the path in a vertical direction;

an array of nozzles on each of said walls, said nozzles being inclined to said web path; and means for supplying a gas to said nozzles for creating a gas cushion to each side of and above and below said web in each stretch for supporting said web in said housing.

2. The apparatus defined in claim 1, further comprising means for drawing off gas from said cushion in a direction parallel to the walls and perpendicular to said transport direction.

3. An apparatus for treating an elongated web moving in a transport direction, said apparatus comprising:

a housing defining a vertical zig-zag path having a succession of oppositely directed and inclined stretches, the stretches alternately extending to right and left and having a vertical rise distance less than the horizontal travel;

a pair of generally parallel and confronting walls in said housing and flanking each of said stretches above and below the web;

means in said housing for guiding and passing said web along said path through said housing in said direction;

an array of nozzles on each of said walls;

means for supplying a gas to said nozzles for creating a gas cushion to each side of and above and below said web in each stretch for supporting said web in said housing; and means for drawing off gas from said cushion in a direction parallel to the walls and perpendicular to said transport direction, each of said walls being formed with a multiplicity of alternating parallel troughs and crests, said nozzles being provided generally at said crests, and said means for withdrawing being effective at the ends of the said troughs.

4. The apparatus defined in claim 3, wherein said means for withdrawing is connected to alternate ends of said troughs.

5. The apparatus defined in claim 3, wherein said means for supplying and said means for withdrawing include a blower having a pressure side connected to said nozzles and a suction side connected to said alternate ends of said trough.

6. The apparatus defined in claim 4, wherein each of said crests is provided with a row of said nozzles directed generally upstream and at an angle to said web in the respective stretch and another row of nozzles directed generally downstream and at an angle to the web in the respective stretch.

* * * * *